United States Patent [19]

Brown

[11] Patent Number: 4,573,644

[45] Date of Patent: Mar. 4, 1986

[54] CARPET ROLLING MACHINE

[75] Inventor: Robert W. Brown, Anoka, Minn.

[73] Assignee: Production Design Products, Inc., Minneapolis, Minn.

[21] Appl. No.: 705,995

[22] Filed: Feb. 27, 1985

[51] Int. Cl.[4] ..... B65H 18/22

[52] U.S. Cl. ..... 242/67.1 R; 242/DIG. 3; 242/55.1

[58] Field of Search ..... 242/DIG. 3, 55.1, 55, 242/67.1 R, 67.2, 67.3 R, 75.1; 100/88

[56] References Cited

U.S. PATENT DOCUMENTS

| | | | |
|---|---|---|---|
| 1,662,577 | 3/1928 | Johnson | 242/DIG. 3 X |
| 2,174,411 | 9/1939 | Baase et al. | 242/DIG. 3 |
| 3,228,620 | 1/1966 | Lee | 242/DIG. 3 X |
| 3,519,214 | 7/1970 | Konrad et al. | 242/67.1 R |
| 3,776,482 | 12/1973 | Mras | 242/DIG. 3 X |
| 3,850,381 | 11/1974 | Moore | 242/DIG. 3 X |
| 3,964,246 | 6/1976 | Kopaska | 100/88 X |
| 4,434,948 | 3/1984 | Feldkamper | 242/67.1 R X |

FOREIGN PATENT DOCUMENTS

| | | | |
|---|---|---|---|
| 0024665 | 2/1977 | Japan | 242/67.1 R |

*Primary Examiner*—John M. Jillions

*Attorney, Agent, or Firm*—Burd, Bartz & Gutenkauf

[57] ABSTRACT

A machine for quickly and efficiently rolling carpet runners or mats after laundering, for storage, transport and reuse. The machine includes a set of belts for horizontal travel and an interacting set of belts for generally vertical travel and guide means for directing the leading edge of a carpet runner from engagement with the horizontal belts to engagement with the vertical belts. An assembly of arcuate fingers cooperates with the belts to guide the leading edge of a carpet runner into the beginning of a roll and to assist in formation of a tight compact roll of carpet. Power means are provided for driving the belts. Means are provided for retracting the finger assembly from a completed rolled carpet runner. Controls are provided for the drive and retraction means.

16 Claims, 6 Drawing Figures

CARPET ROLLING MACHINE

BACKGROUND OF THE INVENTION

1. Field of the Invention

This invention is directed to a machine for rolling up relatively short lengths of carpet used as temporary runners. In many public buildings, during wet weather, carpet runners or mats are laid on the floor immediately inside of entrances to absorb most of the water and pick up most of the dirt carried in from the outside. This prevents the water and dirt from being carried throughout the building, into elevators, etc. and greatly facilitates the maintenance of building lobbies, hallways, and the like. These carpet runners quickly become soiled and are then laundered and rolled for use when next needed. The present invention is directed to a machine for facilitating rolling up carpet runners after laundering.

2. The Prior Art

No prior art machine for accomplishing the same purpose is known to applicant. Heretofore such laundered carpet runners have been rolled manually.

SUMMARY OF THE INVENTION

Broadly stated, the machine for rolling carpet runners according to the present invention includes a frame supporting a set of at least a pair of spaced apart parallel rollers for rotation in a horizontal plane, one of the rollers being connected to a drive means. A first series of carpet carrying belts are supported by the first set of rollers for longitudinal travel from front to rear in response to rotation of the rollers. These belts are parallel and spaced apart. A further roller is supported within the frame parallel to and spaced above the rearwardmost of the first set of rollers, these comprising a second set of rollers. A second series of belts are supported between the rollers of the second series for generally vertical travel in response to rotation of the rollers. The belts of this second series are also parallel and spaced apart and alternate with the belts of the first series in the spaces between the belts of that series. This second series of belts directs the leading edge of a carpet runner upwardly.

A concave forwardly facing arcuate guide plate is supported at the juncture between the two series of belts, the lower edge of the guide plate extending into the space between the travel paths of the belts. Thus, the travel path of the leading edge of a carpet runner being carried by the horizontally moving belts is interrupted and the end of the runner is guided upwardly into contact with the vertically traveling belts. A plurality of pivotally supported concave downwardly facing fingers extend forwardly in the spaces between the vertically traveling belts to engage the leading edge of a carpet runner guided upwardly by the guide plate to form it into the beginning of a roll. The fingers are spring biased to maintain pressure on the periphery of the carpet roll being formed to insure that the runner is rolled up relatively tightly into a dense compact roll for ease of handling and storage. Appropriate operating controls are provided.

BRIEF DESCRIPTION OF THE DRAWINGS

The invention is illustrated by the accompanying drawings in which corresponding parts are identified by the same numerals and in which:

FIG. 1 is a front elevation of the carpet rolling machine according to the present invention, shown partly broken away and in section to reveal interior structure;

DETAILED DESCRIPTION OF THE PREFERRED EMBODIMENT

Figure 2:
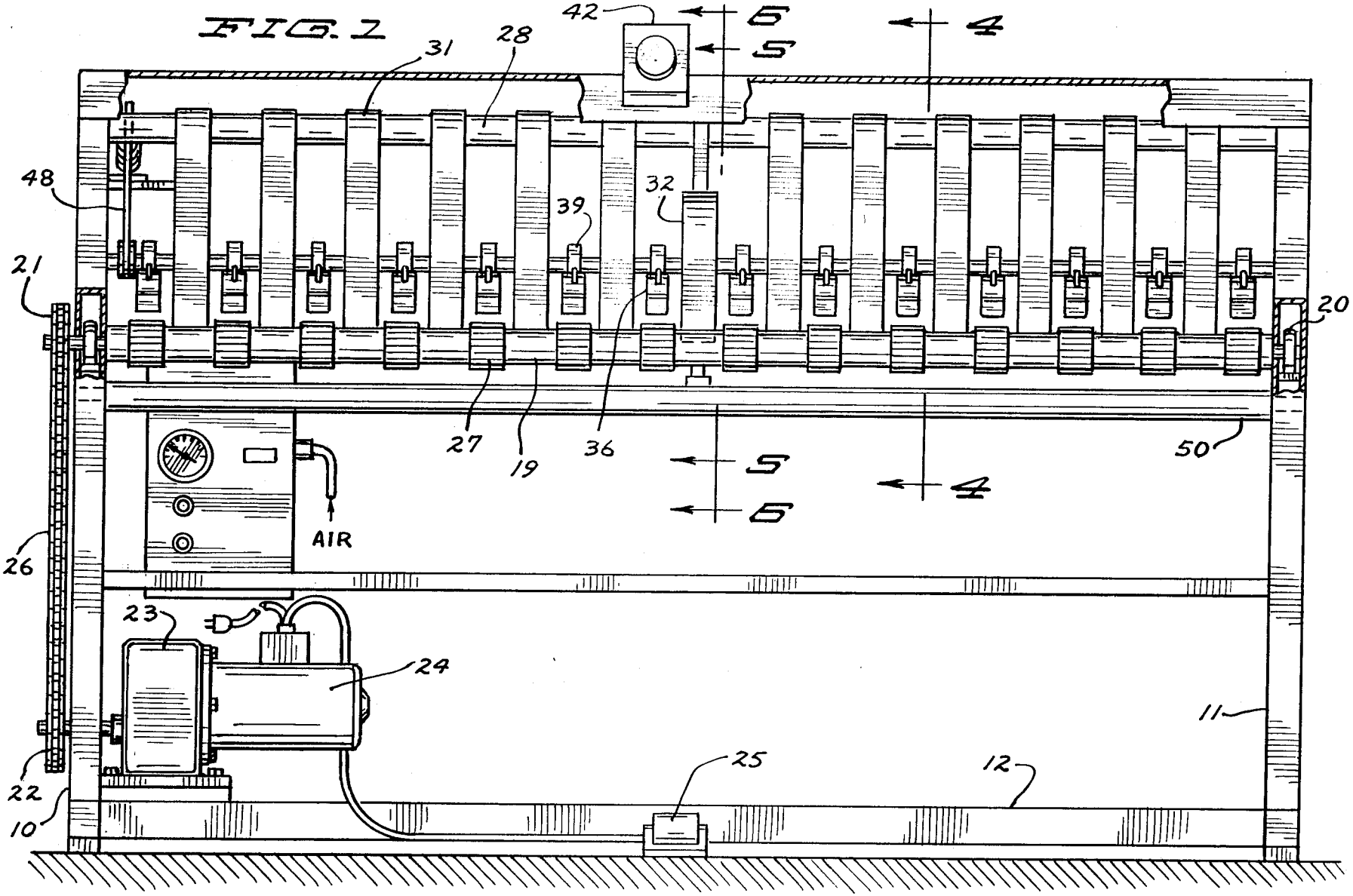
FIG. 2 is a left side elevation thereof.
Figure 3:
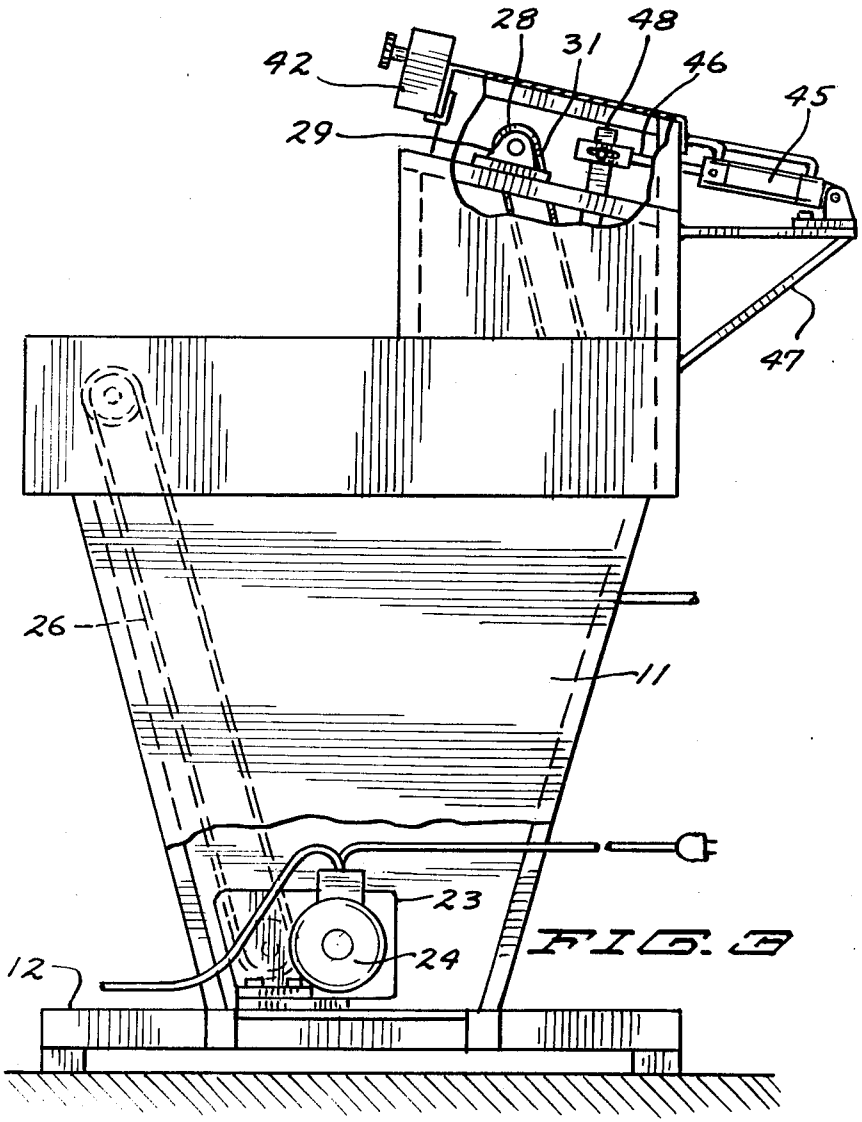
FIG. 3 is a right side elevation thereof, shown with parts broken away and in section.
Figure 2:
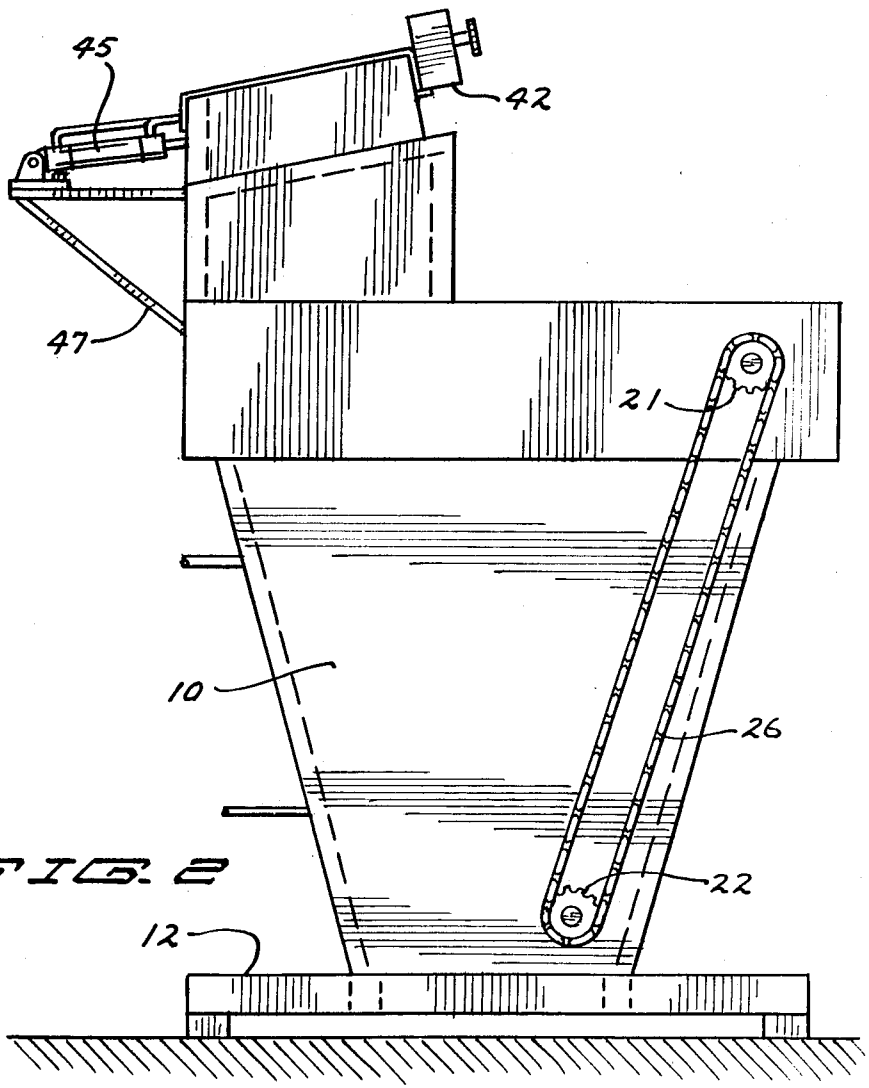

Referring now to the drawings, the carpet rolling machine is partially enclosed within a frame housing including left and right hand spaced apart vertical side wall supports 10 and 11, respectively, supported from a rectangular base 12 and in turn carrying a horizontal intermediate support comprised in part of a plurality of parallel spaced apart transverse beams 13. Base 12 is intended to rest on the laundry floor, preferably supported on casters for movement as needed.

A rearward transverse roller 14 is journaled for rotation in a pair of bearing blocks 15 mounted on plate 16 which in turn is supported by beams 13 of the intermediate frame support. Preferably a further transverse idler roller 17, journaled for rotation in a pair of bearing blocks 18, is also mounted on plate 16. A forward transverse drive roller 19 is journaled in a pair of bearing blocks 20 (FIG. 1) supported in the frame side members. Rollers 14, 17 and 19 are parallel to each other and disposed with their axes lying generally in a horizontal plane, and together constitute a first set of rollers.

The shaft of roller 19 at one end is fitted with a spur gear 21. A further spur gear 22 is driven through gear box 23, of appropriate reduction, by electric motor 24 which is operated by a pedal switch 25. Gears 21 and 22 are interconnected by a drive chain 26 or equivalent drive means. Although not shown, the drive mechanism is enclosed within a protective cover for safety reasons.

A first series of a plurality of identical parallel spaced apart carpet transporting belts 27 extend between roller 19 and roller 14, passing over roller 17.

A horizontal top support frame and housing overlies the rearward end of the intermediate frame support. Transverse horizontal roller 28 is journaled for rotation in a pair of bearing blocks 29 supported by frame members 30 comprising part of the top support frame. Roller 28 is spaced above roller 14 and is parallel thereto. The axes of rollers 14 and 28 lie in a generally vertical plane. Preferably roller 28 is located slightly forward of roller 14 such that the plane formed by their axes inclines forwardly from vertical by about 5° to 15°. Rollers 14 and 28 together comprise a second set of rollers.

A second series of identical parallel spaced apart carpet transporting belts 31 extend between rollers 14 and 28. As best seen in FIG. 1, as they engage roller 14, belts 31 alternate with and lie between belts 27 of the first series. All of the belts are taut. Belts 27 driven by drive roller 19 drive rearward roller 14, which in turn drives belts 31. The outer surfaces of all of the belts are preferably provided with a roughened surface for better engagement with carpet runners. An exemplary belt material is a laced two-ply belt with rough surface obtained from Goodall Rubber Co.

At least one generally concave forwardly facing arcuate guide plate 32 is provided. Guide plate 32 is mounted on a cantilevered support rod 33 which is adjustably mounted in back plate 34 comprising part of the top support frame. Guide plate 32 is mounted at the juncture between the first series of belts 27 and second series of belts 31 so that it extends into the space between the travel paths of the belts so as to interrupt the travel path of the leading edge of a carpet runner carried on belts 27. As best seen by reference to FIG. 5, when the leading edge of carpet runner 35 is carried rearwardly by belts 27, its horizontal path of travel is interrupted when it strikes guide plate 32 and is directed upwardly where it is engaged by belts 31 of the second series of belts.

Figure 5:
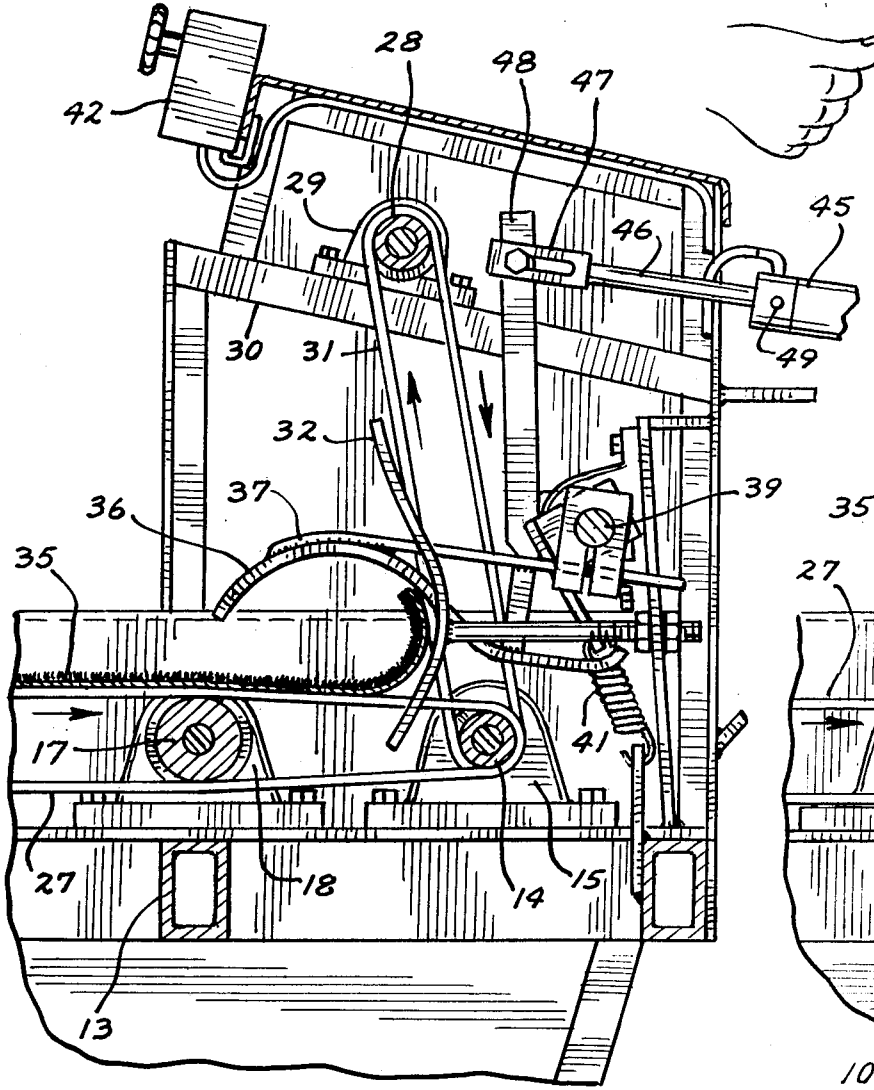
FIG. 5 is a fragmentary section on the line 5—5 of FIG. 1 showing the position of structural elements at the initiation of the rolling process.

As also best seen by reference to FIG. 5, in order to start the formation of a carpet roll, as the leading edge of carpet runner 35 is carried upwardly by belts 31 as a result of its engagement with guide plate 32, it then engages a plurality of concave downwardly facing fingers 36 which reverse the direction of travel of the carpet runner and directs the leading edge forwardly and downwardly. As seen in FIG. 1, each finger 36 is located immediately above a horizontal belt 27 and extends forwardly through the spaces between vertical belts 31.

Figure 4:
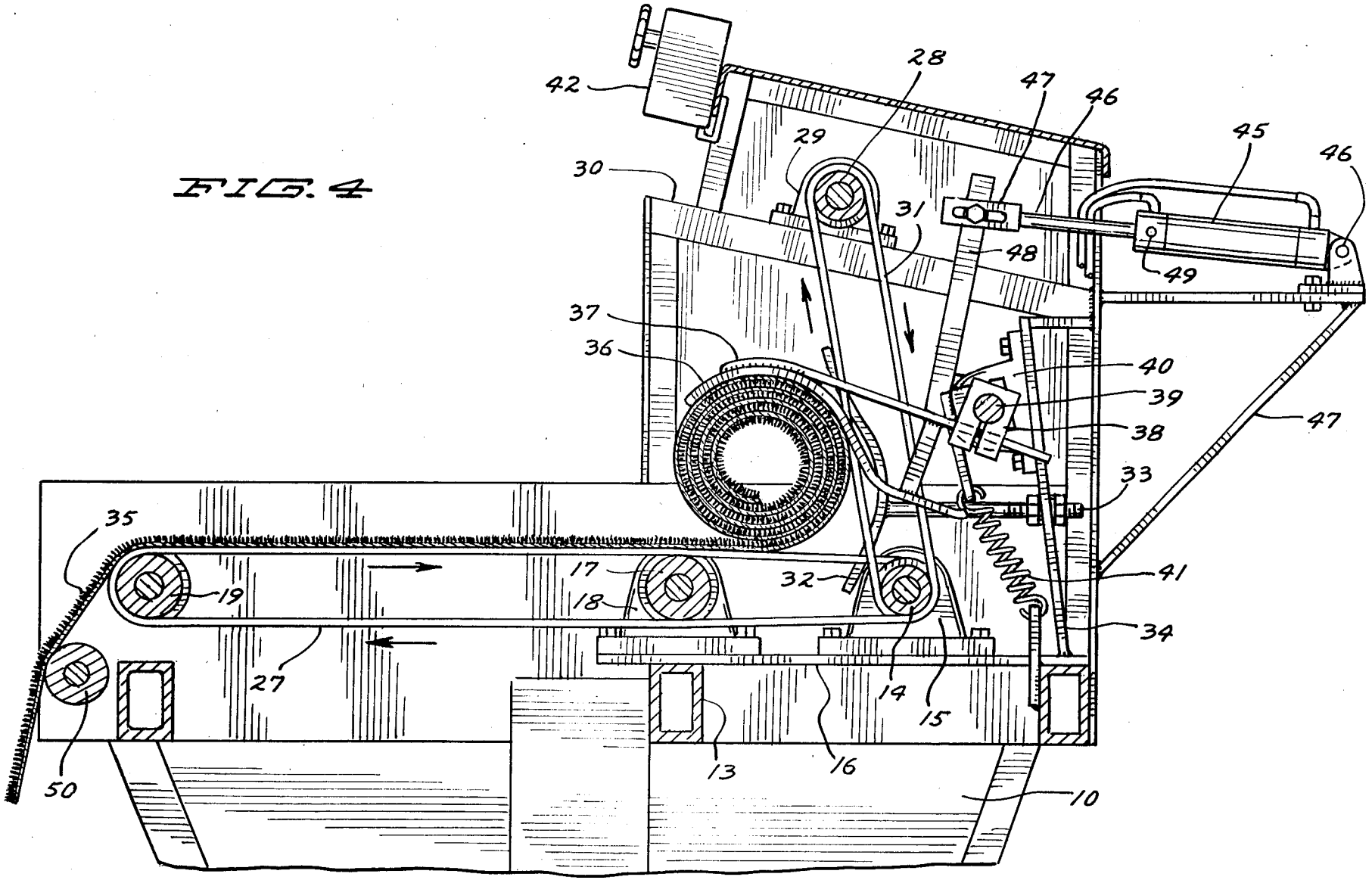
FIG. 4 is a fragmentary section on an enlarged scale on the line 4—4 of FIG. 1 and in the direction of the arrows showing the position of structural elements when the carpet runner is at an intermediate stage in the rolling process.

Each finger 36 is supported from a cantilevered arm 37 whose opposite end is supported in a bracket 38 fixedly secured to shaft 39. Shaft 39 in turn is supported for limited pivotal movement in a pair of bearing blocks 40 mounted on back plate 34. The entire finger assembly is spring biased on its pivot shaft 39 by coil spring 41 so as to exert constant pressure on carpet runner 35 as it is being rolled, as best seen in FIG. 4. Guide plate 32 and fingers 36 are preferably made from or coated with polytetrafluoroethylene polymer, such as is sold under the trademark Teflon.

Figure 6:
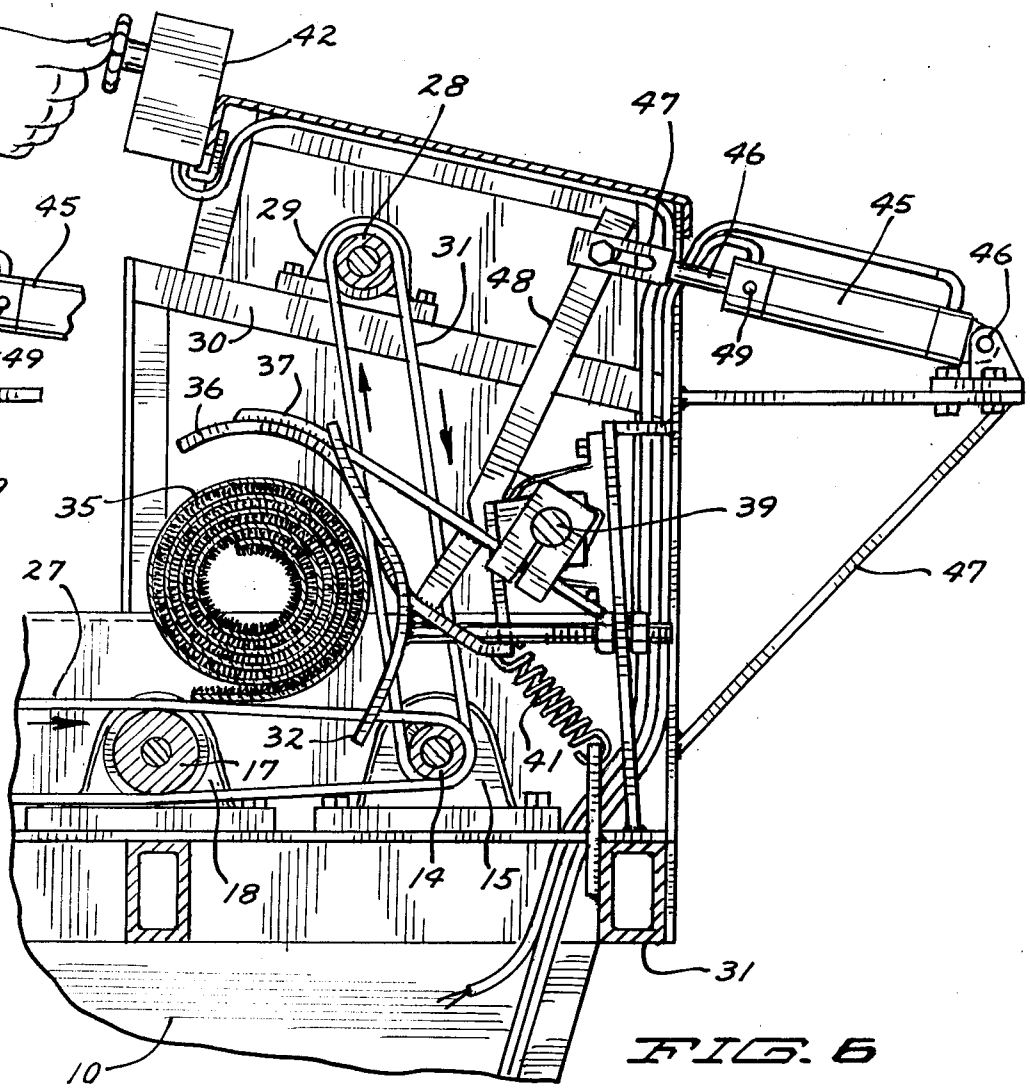
FIG. 6 is a similar fragmentary section on the line 6—6 of FIG. 1 showing the same elements at the conclusion of the rolling process.

Upon the completion of the formation of a carpet roll, as best seen in FIG. 6, movement of the transport belts 27 and 31 is stopped by actuation of the foot switch 25 to shut off motor 24. Then, fingers 26 are released from the carpet roll by actuation of manual switch 42 which is mounted on the top support housing and frame. Switch 42 regulates the flow of air under pressure to a cylinder 45, one end of which is pivotally supported at 46 in a bracket 47 supported from the back wall of the housing. A slotted fitting 47 is secured to the end of piston 46. Fitting 47 pivotally and slidably engages a pin at the top end of lever arm 48, the lower end of which is fixedly secured to shaft 39.

Introduction of compressed air into the piston end of cylinder 45, in response to actuation of switch 42, causes piston 46 to be retracted, which in turn causes arm 48 to rotate shaft 39 and the entire finger assembly to lift fingers 36 from the completed carpet roll to permit its removal. A bleed hose 49 in the cylinder provides controlled bleeding of compressed air from cylinder 45 which, coupled with the tension of spring 41, causes the finger assembly to rotate downwardly into position for rolling of the next length of carpet runner.

An idler roller 50 is desirably journaled in the front edge of the frame, forwardly and slightly downwardly from drive roller 19. This facilitates initial placement of the leading edge of a carpet runner to be rolled for engagement by the transport belts 27.

The carpet rolling machine may be made of width to accommodate those mats and runners ordinarily handled by the commercial laundry in which the machine is employed. Typically such mats or runners are from about 3 to 6 feet in width and about 5 to 15 feet in length.

In the operation of the machine, the finger assembly is initially in the lowermost position, as shown in FIG. 5. With the machine inoperative, the leading edge of the length of carpet runner is lined up with driven roller 19. The machine is turned on by actuation of the foot pedal and the runner is quickly carried by belts 27 and 31 and rolled into a tight compact roll, as seen in FIG. 6. The motor is turned off and the finger assembly is released by manual actuation of switch 42. The rolled carpet is removed and tied or otherwise secured to maintain it in its rolled formation and the finger assembly returns to its initial position, ready to receive the next carpet runner or mat.

It is apparent that many modifications and variations of this invention as hereinbefore set forth may be made without departing from the spirit and scope thereof. The specific embodiments described are given by way of example only and the invention is limited only by the terms of the appended claims.

The embodiments of the invention in which an exclusive property or privilege is claimed are defined as follows:

1. A machine for rolling carpet runners which comprises:

(A) a frame, (B) a first set of at least a pair of spaced apart parallel rollers supported within said frame for rotation in a horizontal plane, (C) drive means connected to one of said rollers, (D) a further roller supported within said frame parallel to and spaced above the rearwardmost of said first set of rollers, (E) a first series of a plurality of endless parallel spaced apart belts supported on said first set of rollers for longitudinal movement in response to rotation of the rollers, (F) a second series of a plurality of endless parallel spaced apart belts supported between the rearwardmost of said first set of rollers and said further roller for generally vertical travel in response to rotation of the rollers, the belts of said second series alternating with the belts of said first series in the spaces between the belts of the first series, (G) at least one concave forwardly facing arcuate guide plate supported at the juncture between said series of belts, the lower end of the guide plate extending into the space between the travel paths of the belts, (H) an assembly of a plurality of concave downwardly facing fingers pivotally supported and extending forwardly in the spaces between said second series of belts and spaced above the first series of belts, and (I) means for controlling operation of said drive means.

2. A machine according to claim 1 wherein:

(A) said further roller is located slightly forward of the rearwardmost of said first set of rollers, and (B) the axes of said rollers lie in a generally vertical plane inclined forwardly by about 5° to 15°.

3. A machine according to claim 1 wherein said drive means is connected to the forwardmost of said first set of rollers.

4. A machine according to claim 3 wherein an idler roller is disposed between and parallel to said forwardmost drive roller and rearwardmost roller of said first set of rollers, the axes of said rollers lying generally in a common plane.

5. A machine according to claim 3 wherein an idler roller is journaled for rotation in the frame closely adjacent to said drive roller, slightly below and forward of, and parallel thereto.

6. A machine according to claim 1 wherein said guide plate and fingers are formed from or coated with polytetrafluoroethylene.

7. A machine according to claim 1 wherein:

(A) said fingers are rigidly supported from a common shaft for pivotal rotation together, (B) said finger assembly is spring biased in a downward direction, and (C) means are provided for retracting said finger assembly against said spring bias.

8. A machine according to claim 7 wherein said retraction means comprises:

(A) a lever arm rigidly secured to said shaft, (B) a fluid operated cylinder supported on said frame adjacent to said lever arm, (C) a pivotal slidable connection between the end of said lever arm and the piston of said cylinder, and (D) means for providing fluid to said cylinder.

9. A machine according to claim 8 wherein:

(A) said cylinder is powered by compressed air, and (B) a bleed hole is provided in the piston end of said cylinder for controlled bleeding of air therefrom in response to the spring bias of the finger assembly.

10. A machine according to claim 1 wherein the outer surfaces of said belts are rough.

11. A machine for rolling carpet runners which comprises:

(A) a frame having:

(1) a base, (2) a pair of vertical side supports, (3) a horizontal intermediate support between said side supports spaced above the base, and (4) a horizontal top support between the side supports and spaced above the rearward end of the intermediate support, (B) a first set of a plurality of at least three spaced apart parallel transverse rollers journaled for rotation in a horizontal plane overlying said intermediate support, (C) drive means connected to the forwardmost of said rollers to rotate the same, (D) a further transverse horizontal roller journaled for rotation spaced above and slightly forward of the rearwardmost of said first set of horizontal rollers, the axes of said rollers lying in a generally vertical plane inclined forwardly between about 5° and 15°, (E) a first series of a plurality of endless parallel spaced apart rough surfaced horizontally traveling belts supported on said first set of horizontal rollers for longitudinal movement responsive to rotation of the rollers, (F) a second series of a plurality of endless parallel spaced apart rough surfaced generally vertically traveling belts supported between the rearwardmost of said first set of horizontal rollers and said further roller, the belts of said second series alternating on said rearwardmost roller with the belts of said first series in the spaces between the belts of the first series, (G) at least one concave forwardly facing arcuate guide plate supported at the juncture between said series of belts, the lower end of said guide plate extending into the space between the travel paths of said belts, (H) an assembly of a plurality of spring biased concave downwardly facing fingers pivotally supported and extending forwardly in the spaces between said second series of belts, and spaced above the first series of belts, (I) means for retracting said finger assembly against its spring bias, and (J) pedal switch means for controlling operation of said drive means.

12. A machine according to claim 11 wherein an idler roller is journaled for rotation in the frame closely adjacent to said drive roller, slightly below and forward of, and parallel thereto.

13. A machine according to claim 11 wherein said guide plate and fingers are formed from or coated with polytetrafluoroethylene.

14. A machine according to claim 11 wherein:

(A) said fingers are rigidly supported from a common shaft for pivotal rotation together, (B) said finger assembly is spring biased in a downward direction.

15. A machine according to claim 14 wherein said retraction means comprises:

(A) a lever arm rigidly secured to said shaft, (B) a fluid operated cylinder supported on said frame adjacent to said lever arm, (C) a pivotal slidable connection between the end of said lever arm and the piston of said cylinder, and (D) means for providing fluid to said cylinder.

16. A machine according to claim 15 wherein:

(A) said cylinder is powered by compressed air, and (B) a bleed hole is provided in the piston end of said cylinder for controlled bleeding of air therefrom in response to the spring bias of the finger assembly.

* * * * *